US011181853B2

(12) United States Patent
Yamashita

(10) Patent No.: US 11,181,853 B2
(45) Date of Patent: Nov. 23, 2021

(54) FIXING DEVICE AND IMAGE FORMING APPARATUS

(71) Applicant: Ricoh Company, Ltd., Tokyo (JP)

(72) Inventor: Kentaro Yamashita, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/111,783

(22) Filed: Dec. 4, 2020

(65) Prior Publication Data

US 2021/0223722 A1 Jul. 22, 2021

(30) Foreign Application Priority Data

Jan. 17, 2020 (JP) ..... JP2020-006080
Mar. 4, 2020 (JP) ..... JP2020-037118

(51) Int. Cl.
*G03G 15/20* (2006.01)

(52) U.S. Cl.
CPC ..... *G03G 15/2017* (2013.01); *G03G 15/2064* (2013.01); *G03G 2215/2003* (2013.01)

(58) Field of Classification Search
CPC ..... G03G 15/2017; G03G 2215/2003
See application file for complete search history.

(56) References Cited

U.S. PATENT DOCUMENTS

2011/0200369 A1 8/2011 Shinshi
2012/0148303 A1* 6/2012 Yamaguchi ..... G03G 15/2053 399/122
2014/0301761 A1* 10/2014 Sugiyama ..... G03G 15/2057 399/333
2018/0203386 A1* 7/2018 Hirose ..... G03G 15/2053
2019/0086847 A1* 3/2019 Tanaka ..... G03G 15/2057

FOREIGN PATENT DOCUMENTS

JP 8-292668 11/1996
JP 2011-164514 8/2011
JP 2015-081946 4/2015
JP 2018-116268 7/2018

* cited by examiner

*Primary Examiner* — Carla J Therrien
(74) *Attorney, Agent, or Firm* — Xsensus LLP

(57) ABSTRACT

A fixing device includes a fixing rotator that is endless and rotates in a rotation direction and a pressure rotator that contacts an outer circumferential surface of the fixing rotator to form a nip between the fixing rotator and the pressure rotator. A flange is disposed opposite each lateral end of the fixing rotator in an axial direction of the fixing rotator and contacts an inner circumferential surface of the fixing rotator. The flange includes a first portion disposed farthest from the nip and a second portion disposed in proximity to the nip. The flange is inclined to define a distance from the inner circumferential surface of the fixing rotator to the flange in a separation direction in which the flange separates from the inner circumferential surface of the fixing rotator. The distance increases from the first portion to the second portion.

10 Claims, 11 Drawing Sheets

FIXING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2020-006080, filed on Jan. 17, 2020, and 2020-037118, filed on Mar. 4, 2020, in the Japan Patent Office, the entire disclosure of each of which is hereby incorporated by reference herein.

BACKGROUND

Technical Field

Exemplary aspects of the present disclosure relate to a fixing device and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

The image forming apparatuses form a toner image through image forming processes of electrophotographic recording, electrostatic recording, magnetic recording, or the like and transfer the toner image onto a recording medium by an indirect transfer method (e.g., an image transfer method) or a direct transfer method, thus forming an unfixed toner image on the recording medium. Such image forming apparatuses include a fixing device that fixes the unfixed toner image on the recording medium. The fixing device includes a fixing rotator, that is, a fixing belt as an endless belt, and a pressure roller. As the recording medium bearing the unfixed toner image is conveyed through a nip formed between the fixing rotator and the pressure roller, the fixing rotator and the pressure roller fix the unfixed toner image on the recording medium under heat and pressure.

Components including a heater such as a halogen lamp and a nip former are disposed inside a loop formed by the fixing rotator. If the fixing rotator has a decreased outer diameter or the components disposed inside the loop formed by the fixing rotator have an increased size, the fixing rotator may contact the components. In order to prevent the fixing rotator from contacting the components, a restrictor is disposed opposite each lateral end of the fixing rotator in an axial direction thereof. The restrictor restricts motion of the fixing rotator. The restrictor lifts the fixing rotator, attaining stable rotation of the fixing rotator.

However, as the restrictor lifts the fixing rotator, the restrictor may frictionally contact the fixing rotator with increased pressure locally, causing an inner circumferential surface of the fixing rotator to suffer from abrasion and resulting in breakage of each lateral end of the fixing rotator in the axial direction thereof.

SUMMARY

This specification describes below an improved fixing device. In one embodiment, the fixing device includes a fixing rotator that is endless and rotates in a rotation direction and a pressure rotator that contacts an outer circumferential surface of the fixing rotator to form a nip between the fixing rotator and the pressure rotator. A flange is disposed opposite each lateral end of the fixing rotator in an axial direction of the fixing rotator and contacts an inner circumferential surface of the fixing rotator. The flange includes a first portion disposed farthest from the nip and a second portion disposed in proximity to the nip. The flange is inclined to define a distance from the inner circumferential surface of the fixing rotator to the flange in a separation direction in which the flange separates from the inner circumferential surface of the fixing rotator. The distance increases from the first portion to the second portion.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
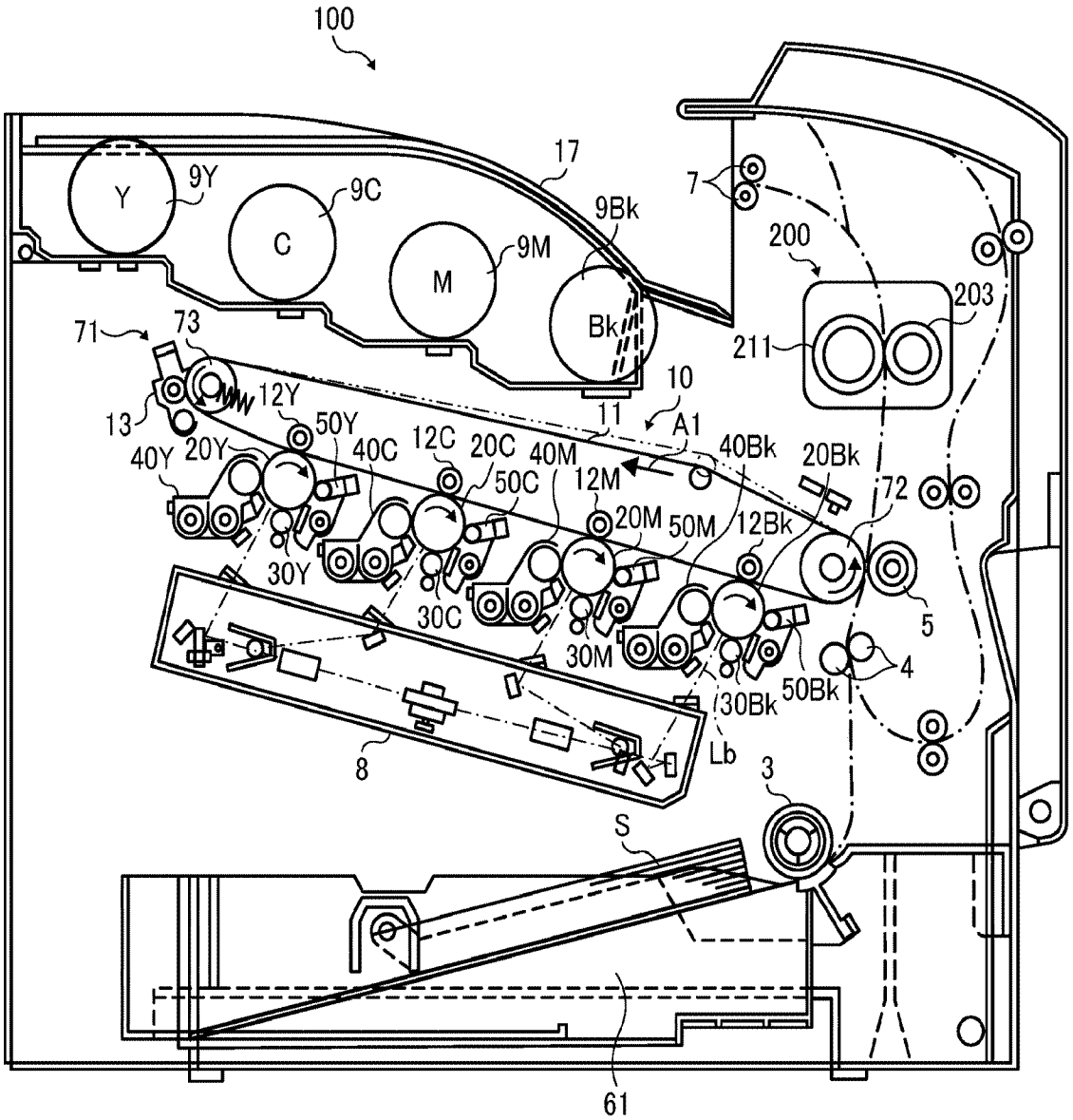
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a fixing device and an image forming apparatus according to embodiments of the present disclosure. The technology of the present disclosure is not limited to the embodiments described below and may be modified within scopes suggested by those skilled in art, such as other embodiments, addition, modification, and deletion. The technology of the present disclosure encompasses various embodiments that achieve operations and advantages of the technology of the present disclosure.

A description is provided of a construction of an image forming apparatus 100.

FIG. 1 is a schematic cross-sectional view of the image forming apparatus 100 according to an embodiment of the present disclosure.

The image forming apparatus 100 illustrated in FIG. 1 is a color printer employing a tandem system in which a plurality of image forming devices that forms images in a plurality of colors, respectively, is aligned in a stretch direction of a transfer belt 11. Alternatively, the image forming apparatus 100 may employ systems other than the tandem system. According to this embodiment, the image forming apparatus 100 is a printer. Alternatively, the image forming apparatus 100 may be a copier, a facsimile machine, or the like.

The image forming apparatus 100 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt that rotates in a direction A1 while the transfer belt 11 is disposed opposite the photoconductive drums 20Y, 20C, 20M, and 20Bk. In the primary transfer process, yellow, cyan, magenta, and black toner images are transferred onto the transfer belt 11 such that the yellow, cyan, magenta, and black toner images are superimposed on the transfer belt 11. Thereafter, the visible images formed on the transfer belt 11 are transferred collectively onto a recording medium S (e.g., a recording sheet) in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk that forms the black toner image as an example, a charger 30Bk, a developing device 40Bk, a primary transfer roller 12Bk, and a cleaner 50Bk which form the black toner image are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 8 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. The primary transfer rollers 12Y, 12C, 12M, and 12Bk disposed opposite the photoconductive drums 20Y, 20C, 20M, and 20Bk via the transfer belt 11 apply a voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from the upstream photoconductive drum 20Y to the downstream photoconductive drum 20Bk in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 5, a belt cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 is disposed opposite the transfer belt 11 and rotates in accordance with rotation of the transfer belt 11. The belt cleaner 13 is disposed opposite the transfer belt 11 and cleans the transfer belt 11. The optical writing device 8 is disposed opposite and below the four imaging stations.

The optical writing device 8 includes a semiconductor laser serving as a light source, a coupling lens, an f-θ lens, a toroidal lens, a reflection mirror, and a polygon mirror serving as a deflector. The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the light beam Lb directed to the imaging station that forms the black toner image, the light beams Lb are also directed to the imaging stations that form the yellow, cyan, and magenta toner images, respectively.

The image forming apparatus 100 further includes a sheet feeder 61, a registration roller pair 4, and a sensor. The sheet feeder 61 is a sheet feeding tray (e.g., a paper tray) that loads recording media S to be conveyed to a secondary transfer nip formed between the secondary transfer roller 5 and the transfer belt 11. The registration roller pair 4 feeds the recording medium S conveyed from the sheet feeder 61 to the secondary transfer nip formed between the secondary transfer roller 5 and the transfer belt 11 at a predetermined time when the yellow, cyan, magenta, and black toner images formed on the transfer belt 11 by the imaging stations, respectively, reach the secondary transfer nip. The sensor detects that a leading edge of the recording medium S reaches the registration roller pair 4.

The image forming apparatus 100 further includes a fixing device 200, a sheet ejection roller pair 7, a sheet ejection tray 17, and toner bottles 9Y, 9C, 9M, and 9Bk. The fixing device 200 is a fuser unit that fixes a color toner image on the recording medium S in a belt fixing method. The color toner image is formed by transferring the yellow, cyan, magenta, and black toner images formed on the transfer belt 11 onto the recording medium S. The sheet ejection roller pair 7 ejects the recording medium S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording media S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. Hence, a biasing member such as a spring biases the driven roller 73 against the transfer belt 11. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording medium S. As the sheet feeding roller 3 is driven and rotated counter-clockwise in FIG. 1, the sheet feeding roller 3 feeds the uppermost recording medium S to the registration roller pair 4.

The belt cleaner 13 installed in the transfer device 71, although the belt cleaner 13 is schematically illustrated in FIG. 1, includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11.

The belt cleaner 13 further includes a discharging device that conveys the residual toner removed from the transfer belt 11 for disposal.

Referring to FIGS. 2A, 2B, 2C, 3, and 4, a description is provided of a construction of a fixing device 200C according to a comparative example.

The construction of the fixing device 200C described below, except a restrictor 210C, is applicable to the fixing device 200 depicted in FIG. 1.

Figure 2A:
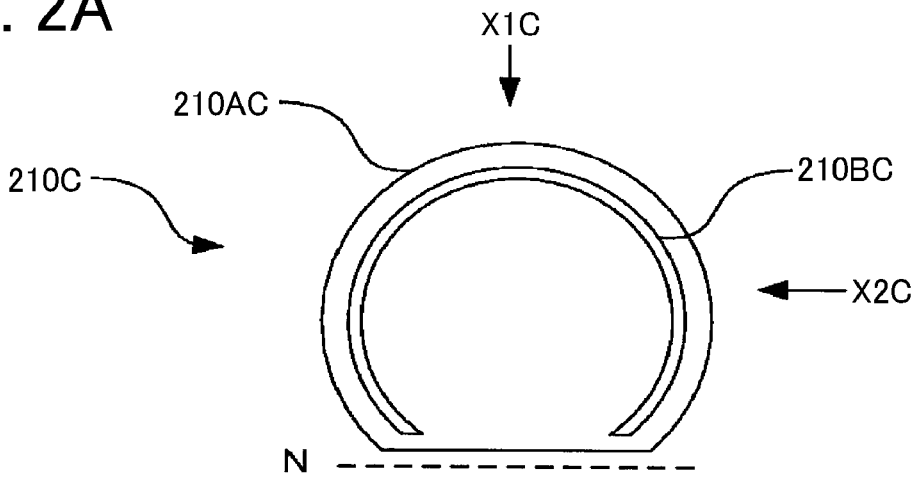
FIG. 2A is a front view of a restrictor according to a comparative example.
Figure 2B:
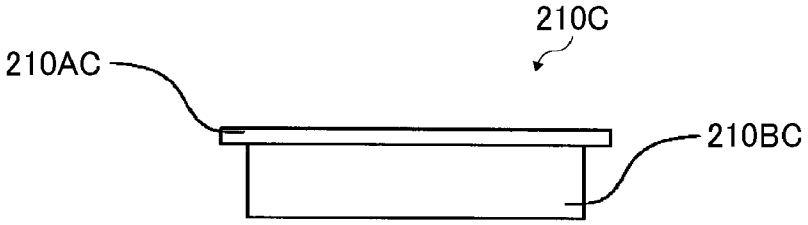
FIG. 2B is a plan view of the restrictor depicted in FIG. 2A, seen in a direction X1C in FIG. 2A.
Figure 2C:
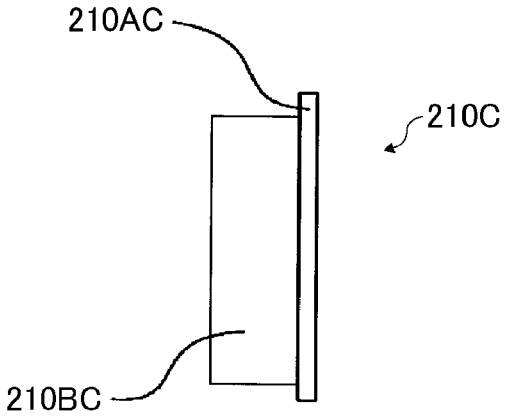
FIG. 2C is a side view of the restrictor depicted in FIG. 2A, seen in a direction X2C in FIG. 2A.
Figure 3:
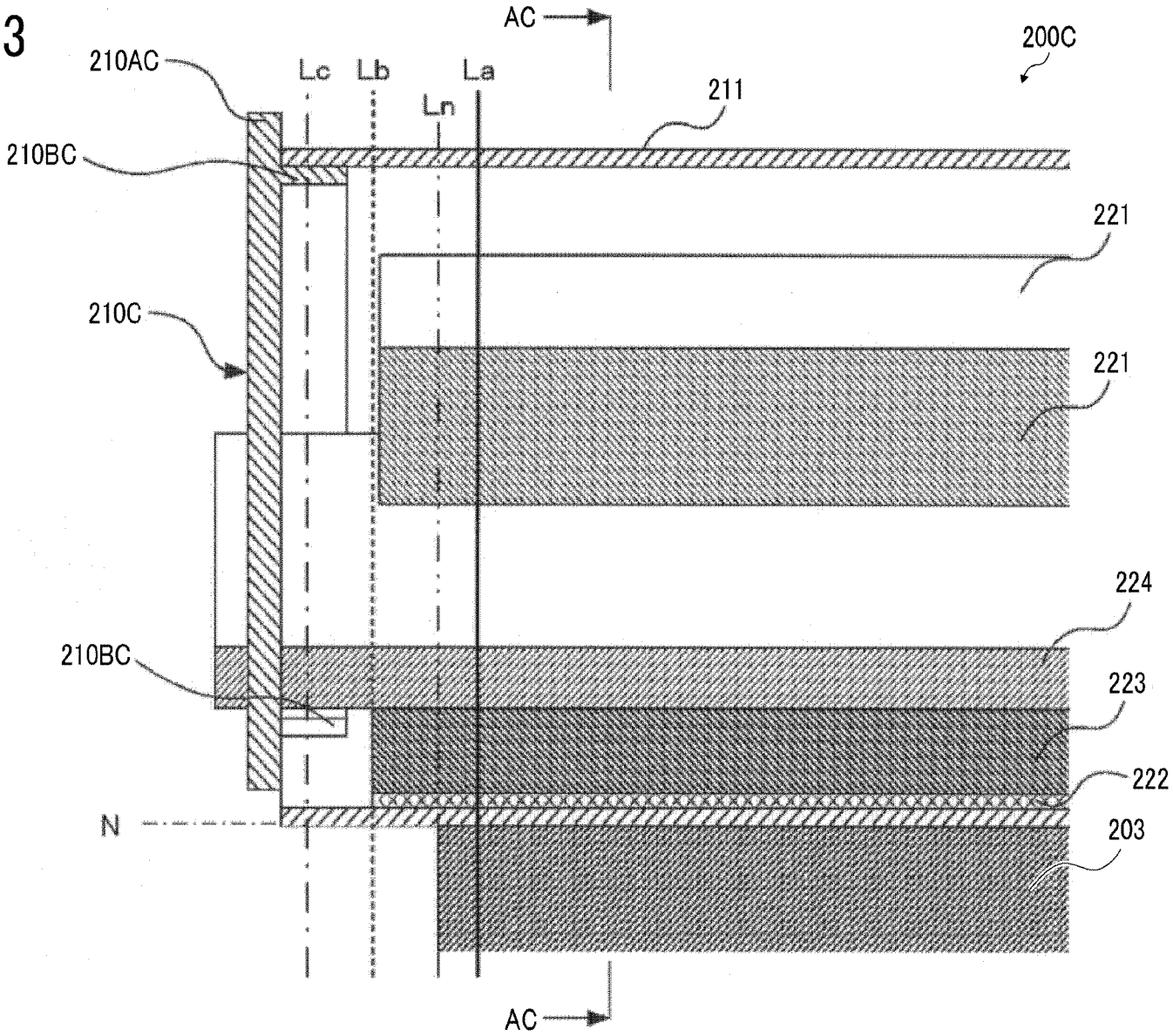
FIG. 3 is a vertical cross-sectional view of a fixing device according to a comparative example on a cross section taken on line in an axial direction of the restrictor depicted in FIG. 2A at a spot in proximity to the restrictor.
Figure 4:
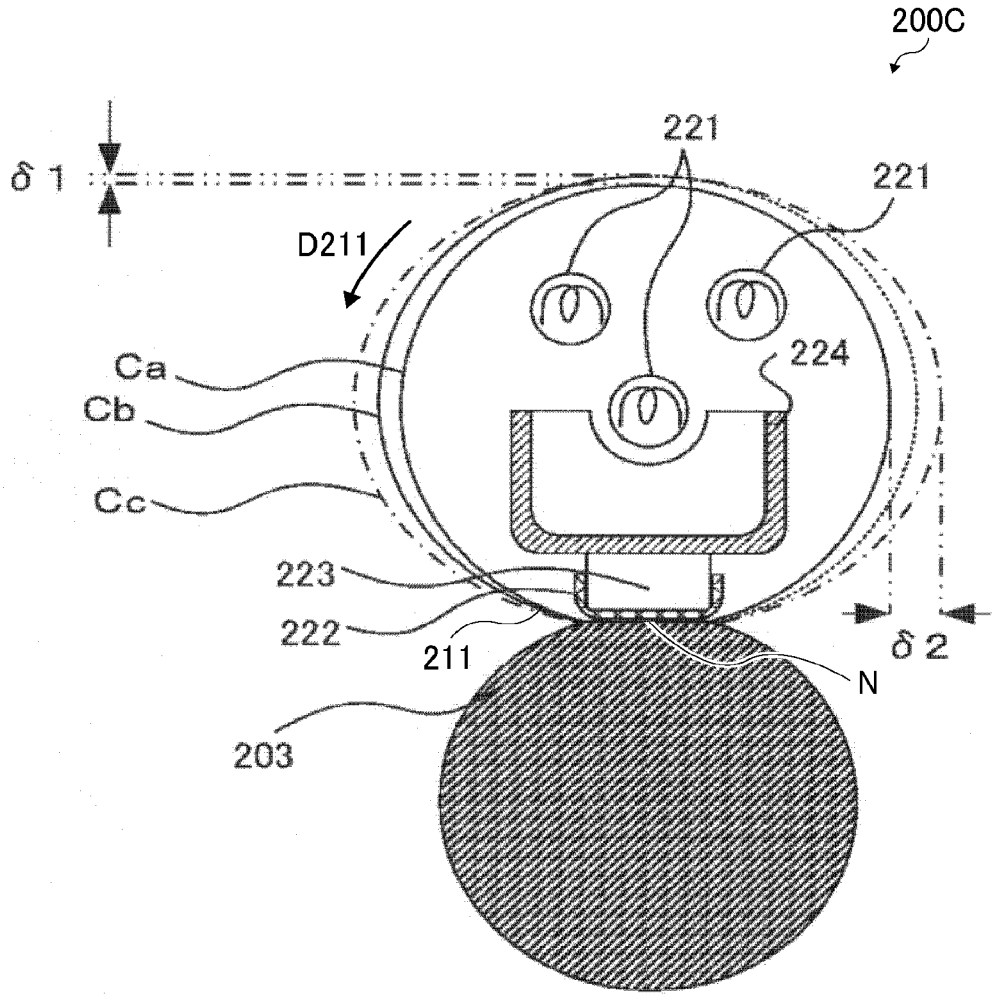
FIG. 4 is a cross-sectional view of the fixing device depicted in FIG. 3 on a cross section taken on line AC-AC in FIG. 3, illustrating a rotation trajectory of a fixing rotator incorporated in the fixing device.

FIGS. 2A, 2B, and 2C illustrate the restrictor 210C incorporated in the fixing device 200C. FIG. 3 is a vertical cross-sectional view of the fixing device 200C on a cross section taken on line in an axial direction of the restrictor 210C, illustrating a vicinity of the restrictor 210C. FIG. 4 is a cross-sectional view of the fixing device 200C on a cross section taken on line AC-AC in FIG. 3, illustrating a trajectory of a fixing rotator 211 that rotates.

As illustrated in FIGS. 2A, 2B, 2C, 3, and 4, the fixing device 200C includes the fixing rotator 211, a plurality of heat sources 221, a nip former 223, a stay 224, a thermal conduction aid 222, and a pressure roller 203. The fixing rotator 211 is an endless belt or a fixing belt that rotates in a rotation direction D211. The heat sources 221 heat the fixing rotator 211. The nip former 223 (e.g., a nip formation pad) is stationarily disposed within a loop formed by the fixing rotator 211 such that the nip former 223 is disposed opposite an inner circumferential surface of the fixing rotator 211 and does not rotate. The thermal conduction aid 222 facilitates conduction of heat in the fixing rotator 211. The pressure roller 203 contacts an outer circumferential surface of the fixing rotator 211. The pressure roller 203 is disposed opposite the nip former 223 via the fixing rotator 211 to form a fixing nip N between the fixing rotator 211 and the pressure roller 203. The pressure roller 203 serves as a pressure rotator and is hereinafter referred to as an opposed rotator also. As a recording medium S bearing an unfixed toner image is conveyed through the fixing nip N, the fixing rotator 211 and the pressure roller 203 fix the unfixed toner image on the recording medium S.

The plurality of heat sources 221 such as halogen heaters is disposed opposite the inner circumferential surface of the fixing rotator 211 and heats the fixing rotator 211 directly with radiant heat. The pressure roller 203 serving as a pressure rotator or an opposed rotator is pressed against the nip former 223 via the fixing rotator 211 to form the fixing nip N between the fixing rotator 211 and the pressure roller 203. As a recording medium S bearing an unfixed toner image is conveyed through the fixing nip N, the fixing rotator 211 and the pressure roller 203 fix the unfixed toner image on the recording medium S.

Inside the loop formed by the fixing rotator 211 are the nip former 223, the thermal conduction aid 222, and the stay 224. The nip former 223 is disposed opposite the pressure roller 203 via the fixing rotator 211. The thermal conduction aid 222 covers an opposed face of the nip former 223, that is disposed opposite the inner circumferential surface of the fixing rotator 211. The stay 224 supports the nip former 223 against pressure from the pressure roller 203.

The nip former 223 presses against the pressure roller 203 via the fixing rotator 211 to form the fixing nip N between the fixing rotator 211 and the pressure roller 203. The inner circumferential surface of the fixing rotator 211 slides over the nip former 223 indirectly via the thermal conduction aid 222.

In the fixing device 200C, as a recording medium S bearing a toner image passes through the fixing nip N, the fixing rotator 211 and the pressure roller 203 melt toner of the toner image borne on the recording medium S under heat and fix the toner image on the recording medium S under pressure.

A contact face of the thermal conduction aid 222, that contacts the fixing rotator 211, is treated with a slide coating that decreases a coefficient of friction and facilitates sliding of the fixing rotator 211. As the slide coating, for example, a fluorine coating, a glass coating with diamond-like carbon (DLC) or the like having an increased abrasion resistance, or the like is used.

The contact face of the thermal conduction aid 222, that contacts the fixing rotator 211, is applied with a lubricant. Fluorine grease or silicone oil that has an increased heat resistant temperature is used as the lubricant. The fluorine grease is a lubricant prepared by dispersing a thickener in fluorine oil as base oil to produce a gel. Since a viscosity of the fluorine grease is greater than a viscosity of oil, the fluorine grease is effectively used to prevent the lubricant from leaking from a slide portion of the thermal conduction aid 222, over which the fixing rotator 211 slides.

The thermal conduction aid 222 prevents heat from being stored locally. The thermal conduction aid 222 conducts heat in a longitudinal direction thereof, facilitating conduction of heat in the fixing rotator 211 in a longitudinal direction thereof and therefore decreasing unevenness in the temperature of the fixing rotator 211 in the longitudinal direction thereof.

Hence, the thermal conduction aid 222 is preferably made of a material that conducts heat in a shortened time period. For example, the thermal conduction aid 222 is made of a material having an increased thermal conductivity, such as copper, aluminum, and silver. Copper is most preferable by comprehensively considering costs, availability, thermal conductivity, and processing.

According to this embodiment, the contact face of the thermal conduction aid 222, that contacts the fixing rotator 211 directly, serves as a nip forming face that defines the fixing nip N.

A detailed description is now given of a construction of the fixing rotator 211.

The fixing rotator 211 is an endless belt or film made of metal such as nickel and stainless used steel (SUS) or resin such as polyimide. The fixing rotator 211 includes a base layer and a release layer. The release layer serves as a surface layer made of perfluoroalkoxy alkane (PFA), polytetrafluoroethylene (PTFE), or the like, facilitating separation of the recording medium S from the fixing rotator 211 and preventing toner from adhering to the fixing rotator 211. Optionally, an elastic layer made of silicone rubber or the like may be interposed between the base layer and the release layer. If the fixing rotator 211 does not incorporate the elastic layer, the fixing rotator 211 attains a decreased thermal capacity that improves a fixing property of being heated quickly. However, when the pressure roller 203 presses and deforms an unfixed toner image to fix the toner image on the recording medium S, slight surface asperities of the fixing rotator 211 may be transferred onto the toner image, causing a disadvantage that an orange peel mark remains on a solid part of the toner image as uneven gloss of the toner image or an orange peel image. To address this circumstance, the elastic layer has a thickness of 100 μm or more. As the elastic layer deforms, the elastic layer absorbs the slight surface asperities, preventing the orange peel mark on the toner image.

A sliding face of the fixing rotator 211, that slides over the thermal conduction aid 222, may be treated with the slide coating described above. In this case, considering heat resistance and abrasion resistance, a material such as polyimide and polyamide imide may be selected.

The heat sources 221 disposed opposite the inner circumferential surface of the fixing rotator 211 heat the fixing rotator 211 directly with radiant heat in a circumferential span of the fixing rotator 211 other than the fixing nip N.

A detailed description is now given of a construction of the pressure roller 203.

The pressure roller 203 includes a cored bar, an elastic rubber layer, and a release layer. The elastic rubber layer is disposed on the cored bar. The release layer serves as a surface layer that facilitates separation of the recording medium S from the pressure roller 203. The release layer is made of PFA, PTFE, or the like. A driving force is transmitted to the pressure roller 203 from a driver such as a motor disposed in the image forming apparatus 100 through a gear, thus rotating the pressure roller 203. A spring or the like biases the pressure roller 203 against the fixing rotator 211. As the spring presses and deforms the elastic rubber layer, the pressure roller 203 forms the fixing nip N having a predetermined length in a recording medium conveyance direction.

The pressure roller 203 may be a solid roller or a hollow roller. A heat source such as a halogen heater may be disposed inside the pressure roller 203 as the hollow roller. The elastic rubber layer may be made of solid rubber. Alternatively, if no heater is disposed inside the pressure roller 203, sponge rubber may be used. The sponge rubber enhances thermal insulation of the pressure roller 203, preferably causing the pressure roller 203 to draw less heat from the fixing rotator 211.

The fixing rotator 211 rotates in accordance with rotation of the pressure roller 203. With the construction of the fixing device 200C illustrated in FIG. 3, as the driver drives and rotates the pressure roller 203, the driving force is transmitted from the pressure roller 203 to the fixing rotator 211 at the fixing nip N, rotating the fixing rotator 211 in accordance with rotation of the pressure roller 203. The fixing rotator 211 rotates while the nip former 223 and the pressure roller 203 sandwich the fixing rotator 211 at the fixing nip N. The fixing rotator 211 rotates while the restrictor 210C guides the fixing rotator 211 at each lateral end of the fixing rotator 211 in an axial direction, that is, the longitudinal direction, thereof in the circumferential span of the fixing rotator 211 other than the fixing nip N.

The restrictor 210C is disposed opposite each lateral end of the fixing rotator 211 having a sleeve shape in the axial direction thereof. The restrictor 210C restricts a trajectory of rotation of the fixing rotator 211.

FIG. 2A is a front view of the restrictor 210C. FIG. 2B is a plan view of the restrictor 210C, seen in a direction X1C in FIG. 2A. FIG. 2C is a side view of the restrictor 210C, seen in a direction X2C in FIG. 2A.

As illustrated in FIGS. 2A, 2B, and 2C, the restrictor 210C includes an axial direction restricting portion 210AC and a flange 210BC. The axial direction restricting portion

210AC is shaped substantially in a disk that is partially cut or straightened along a plane of the fixing nip N in the front view. For example, the axial direction restricting portion 210AC is U-shaped in the front view. The flange 210BC is mounted on a planar face of the axial direction restricting portion 210AC. The flange 210BC is shaped substantially in a tube that is partially cut or straightened along the plane of the fixing nip N in the front view. For example, the flange 210BC is U-shaped in the front view.

As illustrated in FIG. 3, the restrictor 210C is disposed opposite each lateral end of the fixing rotator 211 in the axial direction thereof. The restrictor 210C is inserted and fitted into the fixing rotator 211 such that the inner circumferential surface of the fixing rotator 211 contacts the flange 210BC and a lateral edge of the fixing rotator 211 in the axial direction thereof contacts the axial direction restricting portion 210AC.

A description is provided of a construction of a comparative fixing device.

The comparative fixing device includes a fixing rotator and a comparative restrictor. The comparative restrictor includes a flange that contacts an inner circumferential surface of the fixing rotator to restrict an orbit of the fixing rotator in a radial direction thereof. The flange is inclined with respect to an axial direction of the fixing rotator.

For example, the flange includes a top face and a side face. The top face is disposed opposite a nip, formed between the fixing rotator and a pressure rotator, via a shaft of the fixing rotator, that extends in a longitudinal direction of the fixing rotator. The side face is disposed closer to the nip than the top face is. An inclination angle of the top face is greater than an inclination angle of the side face. The flange has a shape that fits a trajectory of the fixing rotator that rotates, thus preventing the fixing rotator from receiving a force locally and thereby suppressing abrasion of the fixing rotator.

However, the comparative fixing device may employ the fixing rotator made of a material, such as nickel and SUS, that has a greater rigidity compared to resin such as polyimide. That is, the fixing rotator has an increased Young's modulus. In this case, the flange may not suppress abrasion of the fixing rotator effectively.

The fixing rotator having the increased Young's modulus draws a trajectory of rotation that is different from a trajectory of rotation of a fixing rotator having a Young's modulus that is smaller than the increased Young's modulus. For example, the fixing rotator having the increased Young's modulus may contact the side face of the flange with increased pressure.

Hence, the comparative restrictor may cause the fixing rotator having the increased Young's modulus to suffer from local abrasion and resultant breakage.

A rotation trajectory Ca depicted in FIG. 4 illustrates a trajectory of rotation of the fixing rotator 211 at an inboard position La disposed inboard from a nip position Ln in the axial direction of the fixing rotator 211 depicted in FIG. 3. For example, the nip position Ln is situated at a fixing nip boundary of the fixing nip N. A rotation trajectory Cb depicted in FIG. 4 illustrates a trajectory of rotation of the fixing rotator 211 at an intermediate position Lb interposed between the nip position Ln and the flange 210BC in the axial direction of the fixing rotator 211 depicted in FIG. 3. A rotation trajectory Cc depicted in FIG. 4 illustrates a trajectory of rotation of the fixing rotator 211 at a flange position Lc disposed on the flange 210BC depicted in FIG. 3.

The rotation trajectories Ca, Cb, and Cc illustrate trajectories of rotation of the fixing rotator 211 that has a Young's modulus greater than that of a general fixing rotator made of resin, for example, a fixing rotator made of polyimide.

The general fixing rotator made of resin has a Young's modulus in a range of from about 3 Gpa to about 10 Gpa. A degree of deformation of the general fixing rotator made of resin from the inboard position La to the flange position Lc indicates that a change δ1 in a top direction (e.g., a vertical direction in FIG. 4) is greater than a change δ2 in a side direction (e.g., a horizontal direction in FIG. 4).

The fixing rotator 211, that has a Young's modulus greater than that of the general fixing rotator made of resin, is made of nickel, SUS, or the like, for example. The fixing rotator 211 has a Young's modulus of about 200 Gpa.

The fixing rotator 211 having the increased Young's modulus draws a trajectory of rotation that deforms substantially toward an outside of the fixing rotator 211 as illustrated in FIG. 4. A degree of deformation of the fixing rotator 211 indicates that the change δ2 in the side direction is greater than the change δ1 in the top direction. The degree of deformation of the fixing rotator 211 is described below.

The fixing rotator 211 is heated by the heat sources 221 such as the halogen heaters. The fixing rotator 211 is pressed by the pressure roller 203 and the thermal conduction aid 222 that is supported by the stay 224 secured to side plates. The fixing rotator 211 is driven and rotated by the driving force from the pressure roller 203.

The inner circumferential surface of the fixing rotator 211, at each lateral end of the fixing rotator 211 in the axial direction thereof, is lifted by an inner circumferential surface restricting face, that is, a contact face, of the flange 210BC, that contacts the inner circumferential surface of the fixing rotator 211. Accordingly, the fixing rotator 211 does not contact the heat sources 221, the stay 224, and the like that are disposed inside the loop formed by the fixing rotator 211. Thus, the fixing rotator 211 rotates stably.

If the base layer, that is, a base, of the fixing rotator 211 is made of a material having an increased rigidity, such as SUS and nickel, the fixing rotator 211 is bent less under an identical load compared to a case in which the base layer of the fixing rotator 211 is made of resin. According to this example, the base layer of the fixing rotator 211 is made of nickel having a Young's modulus of 204 Gpa. Hence, even if the flange 210BC lifts the fixing rotator 211, concerning a trajectory of the fixing rotator 211 in the longitudinal direction thereof at a position in proximity to a top face of the flange 210BC, the change δ1 is small. The change δ1 defines a difference between the trajectory Cc and the trajectories Ca and Cb. On the trajectory Cc, the fixing rotator 211 contacts the inner circumferential surface restricting face of the flange 210BC. On the trajectories Ca and Cb disposed inboard from the trajectory Cc in the longitudinal direction of the fixing rotator 211, the fixing rotator 211 does not contact the inner circumferential surface restricting face of the flange 210BC.

On the other hand, at an upstream position and a downstream position disposed upstream and downstream from the fixing nip N in the rotation direction D211 of the fixing rotator 211, respectively, and disposed in proximity to the fixing nip N, in an order from the trajectory Ca disposed inboard from the fixing nip boundary to the trajectories Cb and Cc disposed outboard from the fixing nip boundary in the longitudinal direction of the fixing rotator 211, while a radius of curvature of the fixing rotator 211 decreases gradually toward the upstream position and the downstream position in proximity to the fixing nip N, the trajectory of the fixing rotator 211 bulges outward. The reason is as follows.

If a trajectory of a sleeve, that is, the fixing rotator 211, at a position in proximity to the plane of the fixing nip N, is the trajectory Ca disposed inboard from the fixing nip boundary in the longitudinal direction of the fixing rotator 211, the fixing rotator 211 is bound and deformed by the fixing nip N. Conversely, if the trajectory of the sleeve is the trajectory Cb or Cc disposed outboard from the fixing nip boundary in the longitudinal direction of the fixing rotator 211, the fixing rotator 211 is bound by the plane of the fixing nip N with a binding force that decreases gradually from the trajectory Cb to the trajectory Cc. Accordingly, the fixing rotator 211 is deformed less and restored to a true circle having decreased energy for deformation. As a result, the change δ2 at the upstream position and the downstream position disposed upstream and downstream from the fixing nip N in the rotation direction D211 of the fixing rotator 211, respectively, and disposed in proximity to the fixing nip N is greater than the change δ1.

Accordingly, the fixing rotator 211 is not parallel to the inner circumferential surface restricting face of the flange 210BC at the upstream position and the downstream position. The fixing rotator 211 slides over the inner circumferential surface restricting face of the flange 210BC with substantial friction on an inboard portion of the inner circumferential surface restricting face, that is disposed closer to a center of the fixing rotator 211 in the longitudinal direction thereof. Accordingly, abrasion of the inner circumferential surface of the fixing rotator 211 progresses. Consequently, a lateral end of the fixing rotator 211 in the longitudinal direction thereof may split, causing the fixing rotator 211 to be unusable.

A method of measuring the Young's modulus is not restricted. However, the Young's modulus is measured or compared by a tensile test with a platy test piece that conforms to the Japanese Industrial Standards (JIS), for example.

The following describes a configuration of the fixing device 200 incorporating a restrictor 210 according to embodiments of the present disclosure.

The fixing rotator 211 is constructed of an inner coat layer serving as the inner circumferential surface, the base layer, the elastic layer, and the release layer that are layered in this order. The base layer is preferably made of a material having a Young's modulus that is relatively high, such as nickel and SUS.

More specifically, the restrictor 210 disposed opposite each lateral end of the fixing rotator 211 in the longitudinal direction thereof is preferably applied to the fixing rotator 211 that has a Young's modulus in a range of from 70 Gpa to 300 Gpa and a thickness in a range of from 30 μm to 50 μm.

A description is provided of a configuration of the restrictor 210 according to a first embodiment of the present disclosure.

Figure 5A:
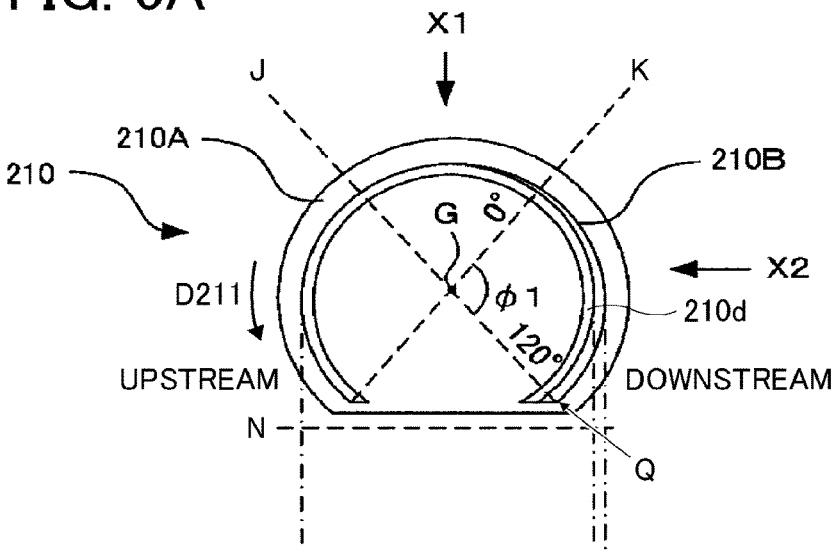
FIG. 5A is a front view of a restrictor according to a first embodiment, that is installed in the fixing device incorporated in the image forming apparatus depicted in FIG. 1.
Figure 5B:
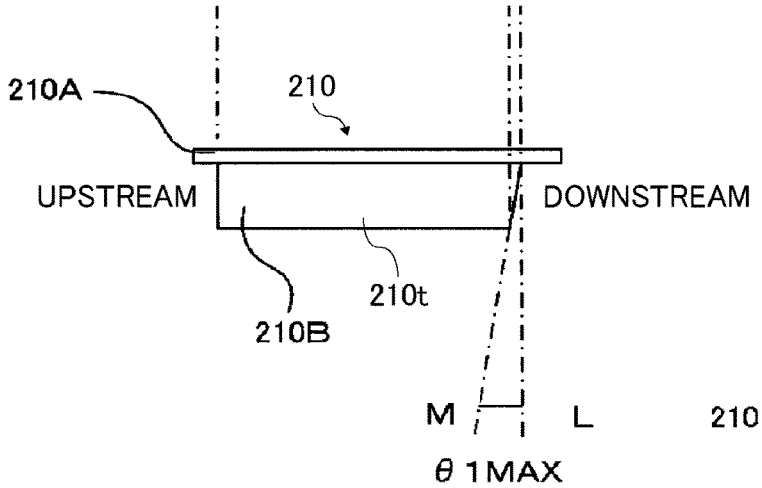
FIG. 5B is a plan view of the restrictor depicted in FIG. 5A, seen in a direction X1 in FIG. 5A.
Figure 5C:
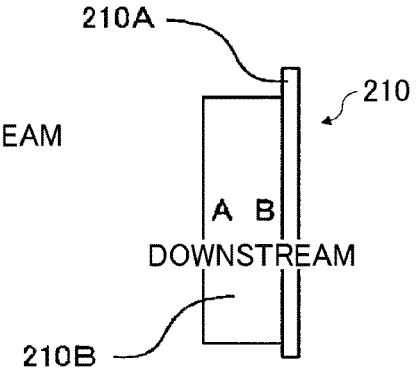
FIG. 5C is a side view of the restrictor depicted in FIG. 5A, seen in a direction X2 in FIG. 5A.
Figure 5D:
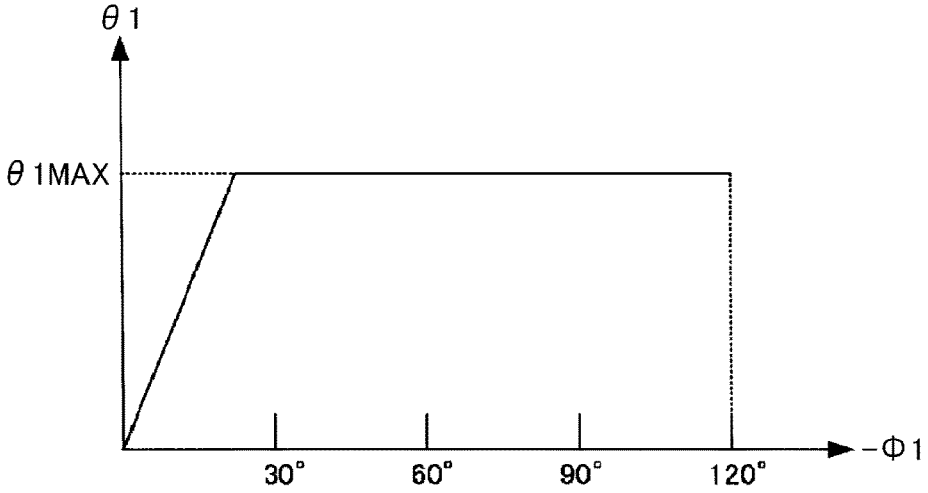
FIG. 5D is a graph illustrating an inclination angle θ1 defined by a normal line M of a flange of the restrictor depicted in FIG. 5B.

FIGS. 5A, 5B, 5C, and 5D are diagrams illustrating the configuration of the restrictor 210 according to the first embodiment, that is incorporated in the fixing device 200 depicted in FIG. 1. As illustrated in FIGS. 5A, 5B, and 5C, the restrictor 210 includes an axial direction restricting portion 210A and a flange 210B. FIG. 5A is a front view of the restrictor 210. FIG. 5B is a plan view of the restrictor 210, seen in a direction X1 in FIG. 5A. FIG. 5C is a side view of the restrictor 210, seen in a direction X2 in FIG. 5A. FIG. 5C illustrates a downstream side of the flange 210B of the restrictor 210 in the rotation direction D211 of the fixing rotator 211. FIG. 5D is a graph illustrating an inclination angle θ1 defined by a normal line M and a line L of the flange 210B, that is disposed on the downstream side of the flange 210B in the rotation direction D211 of the fixing rotator 211. The normal line M is inclined toward an axis G to define the inclination angle θ1.

As illustrated in FIGS. 5A and 5B, the axis G passes through a center of an arc of the flange 210B of the restrictor 210. The normal line M of the flange 210B is inclined toward the axis G to define the inclination angle θ1 in the front view. The inclination angle θ1 increases from a top face 210*t* serving as a first portion to a lower end of a downstream side face 210*d* serving as a second portion. For example, the downstream side face 210*d* is disposed downstream from the fixing nip N in the rotation direction D211 of the fixing rotator 211.

More specifically, the restrictor 210 includes the flange 210B that is inclined with an angle that increases in a separation direction in which the flange 210B separates from the inner circumferential surface of the fixing rotator 211 from the first portion disposed farthest from the fixing nip N to the second portion disposed in proximity to the fixing nip N.

More preferably, in the front view, a straight line J passes through a downstream lower end Q of the flange 210B and the axis G. A straight line K is defined by the straight line J that is rotated about the axis G counterclockwise in FIG. 5A by 120 degrees. The normal line M starts being inclined toward the axis G from a position in proximity to an intersection where the straight line K intersects the flange 210B. The intersection defines 0 degree. The inclination angle θ1 defines a maximum inclination angle θ1MAX at a position in proximity to a most downstream portion of the flange 210B in the recording medium conveyance direction or the rotation direction D211 of the fixing rotator 211. The most downstream portion of the flange 210B defines −φ1 of 30 degrees when counterclockwise rotation defines positive rotation. The maximum inclination angle θ1MAX is retained toward a lower end of the flange 210B in FIG. 5A.

Figure 6:
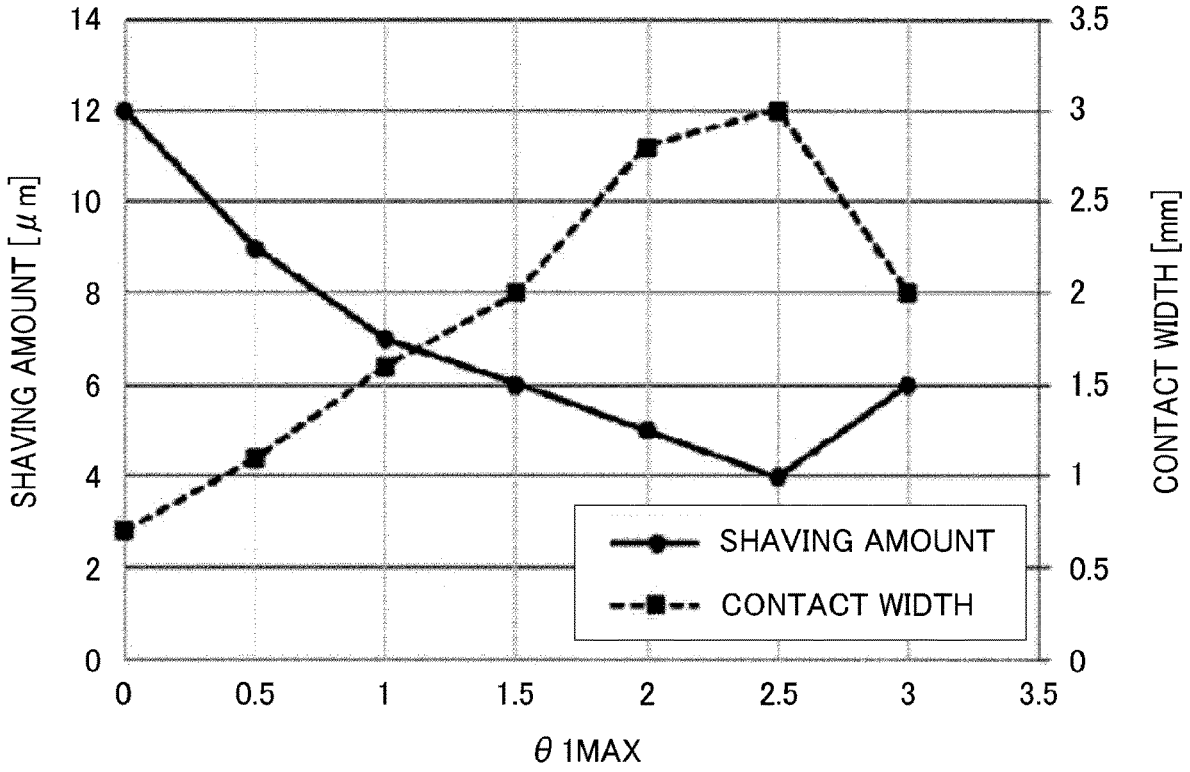
FIG. 6 is a graph illustrating a relation between a maximum inclination angle θ1MAX of the inclination angle θ1 defined by the normal line M of the flange depicted in FIG. 5B and an abrasion amount of an inner circumferential surface of the fixing rotator, that contacts the flange.

FIG. 6 is a graph illustrating a relation between the maximum inclination angle θ1MAX of the inclination angle θ1 defined by the normal line M of the flange 210B and an abrasion amount of the inner circumferential surface of the fixing rotator 211, that contacts the flange 210B.

In FIG. 6, supposing a product life of the fixing device 200, a vertical axis represents a shaving amount (μm) of the fixing rotator 211 after printing on 300,000 sheets of recording media and a contact width (mm) in the longitudinal direction of the fixing rotator 211 for which the fixing rotator 211 contacts the flange 210B. A horizontal axis represents a value (e.g., an angle) of the maximum inclination angle θ1MAX.

The contact width for which the fixing rotator 211 contacts the flange 210B is measured by applying grease on a surface of the flange 210B and observing a shape of the grease that is peeled off.

As illustrated in FIG. 6, as the maximum inclination angle θ1MAX increases, the shaving amount at a position on the inner circumferential surface of the fixing rotator 211, that is disposed opposite a vicinity of a spot A in FIG. 5C, decreases. As the maximum inclination angle θ1MAX increases, the contact width originated at the vicinity of the spot A in FIG. 5C increases.

This means that since the contact width increases as the maximum inclination angle θ1MAX increases, a maximum value of surface pressure exerted to the inner circumferential surface of the fixing rotator 211 decreases, thus reducing the abrasion amount of the fixing rotator 211.

Conversely, as the maximum inclination angle θ1MAX exceeds 2.5 degrees, the shaving amount of the inner circumferential surface of the fixing rotator 211 starts increasing. It is because contact of the fixing rotator 211 with the flange 210B originates at a vicinity of a spot B in FIG. 5C and abrasion of a portion of the fixing rotator 211, that is disposed opposite the vicinity of the spot B, increases.

Accordingly, the maximum inclination angle θ1MAX is in a range of from 1 degree to 3 degrees preferably and 2.5 degrees more preferably.

As described above, in the fixing device 200 according to this embodiment, at least in the downstream side of the flange 210B in the rotation direction D211 of the fixing rotator 211, the inclination angle θ1 defined by the normal line M of the flange 210B in the second portion thereof is greater than that in the first portion of the flange 210B.

Accordingly, even if the fixing device 200 employs the fixing rotator 211 having a relatively great Young's modulus, the restrictor 210 suppresses abrasion of the fixing rotator 211 advantageously.

A description is provided of a configuration of a restrictor 210S according to a second embodiment of the present disclosure.

Figure 7A:
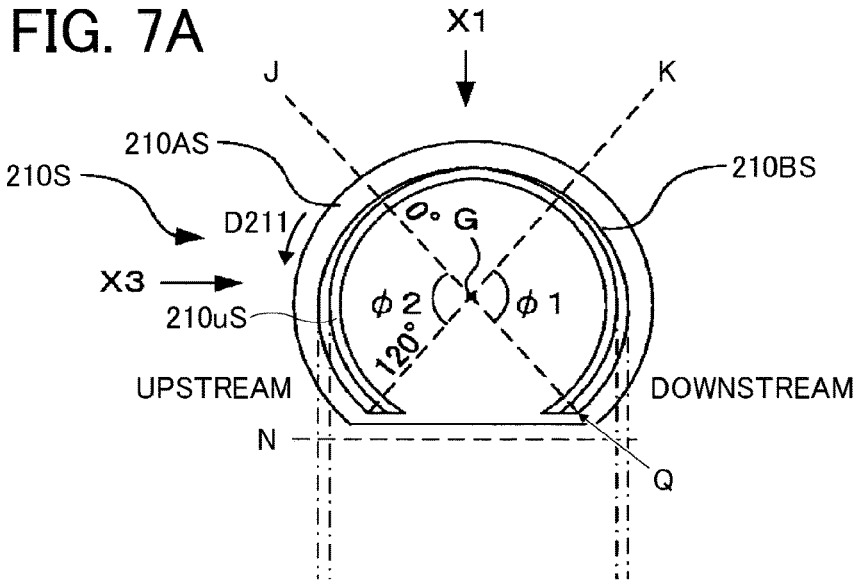
FIG. 7A is a front view of a restrictor according to a second embodiment, that is installable in the fixing device incorporated in the image forming apparatus depicted in FIG. 1.
Figure 7B:
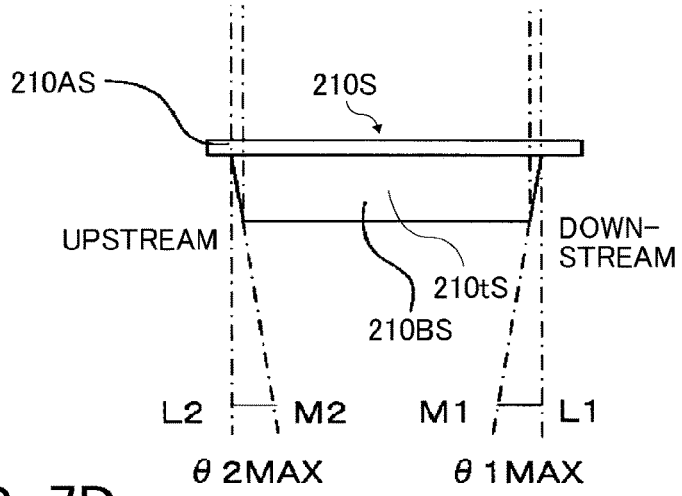
FIG. 7B is a plan view of the restrictor depicted in FIG. 7A, seen in the direction X1 in FIG. 7A.
Figure 7C:
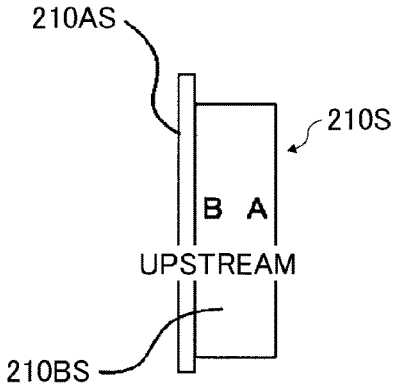
FIG. 7C is a side view of the restrictor depicted in FIG. 7A, seen in a direction X3 in FIG. 7A.
Figure 7D:
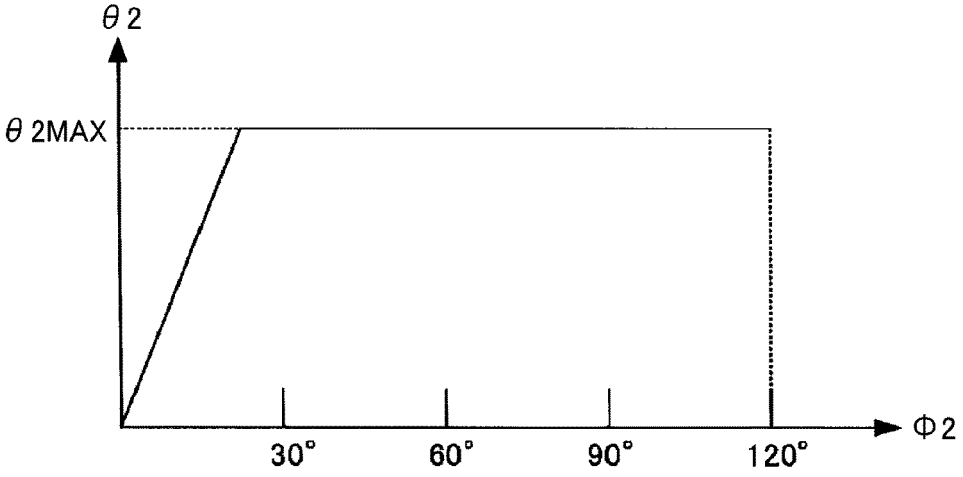
FIG. 7D is a graph illustrating an inclination angle θ2 defined by a normal line M2 of a flange of the restrictor depicted in FIG. 7B.

FIGS. 7A, 7B, 7C, and 7D are diagrams illustrating the configuration of the restrictor 210S according to the second embodiment, that is installable in the fixing device 200 depicted in FIG. 1. As illustrated in FIGS. 7A, 7B, and 7C, the restrictor 210S includes an axial direction restricting portion 210AS and a flange 210BS. FIG. 7A is a front view of the restrictor 210S. FIG. 7B is a plan view of the restrictor 210S, seen in the direction X1 in FIG. 7A. FIG. 7C is a side view of the restrictor 210S, seen in a direction X3 in FIG. 7A. FIG. 7C illustrates an upstream side of the flange 210BS in the rotation direction D211 of the fixing rotator 211. FIG. 7D is a graph illustrating an inclination angle θ2 defined by a normal line M2 and a line L2 of the flange 210BS, that is disposed on the upstream side of the flange 210BS in the rotation direction D211 of the fixing rotator 211. The normal line M2 is inclined toward the axis G to define the inclination angle θ2.

According to the second embodiment, a normal line M1 disposed in a downstream side of the flange 210BS in the rotation direction D211 of the fixing rotator 211 is equivalent to the normal line M of the flange 210B according to the first embodiment depicted in FIG. 5B. The normal line M1 and a line L1 define the inclination angle θ1.

As illustrated in FIGS. 7A and 7B, the axis G passes through a center of an arc of the flange 210BS of the restrictor 210S. The normal line M2 of the flange 210BS is inclined toward the axis G to define the inclination angle θ2 in the front view. The inclination angle θ2 increases from a top face 210*t*S serving as the first portion to a lower end of an upstream side face 210*u*S serving as the second portion. For example, the upstream side face 210*u*S is disposed upstream from the fixing nip N in the rotation direction D211 of the fixing rotator 211.

More specifically, the restrictor 210S includes the flange 210BS that is inclined with an angle that increases in a separation direction in which the flange 210BS separates from the inner circumferential surface of the fixing rotator 211 from the first portion disposed farthest from the fixing nip N to the second portion disposed in proximity to the fixing nip N.

More preferably, in the front view, the straight line J passes through the downstream lower end Q of the flange 210BS and the axis G. The straight line K is defined by the straight line J that is rotated about the axis G counterclockwise in FIG. 7A by 120 degrees. The normal line M2 starts being inclined toward the axis G from a position in proximity to an intersection where the straight line J intersects the flange 210BS. The intersection defines 0 degree. The inclination angle θ2 defines a maximum inclination angle θ2MAX at a position in proximity to a most upstream portion of the flange 210BS in the recording medium conveyance direction or the rotation direction D211 of the fixing rotator 211. The most upstream portion of the flange 210BS defines φ2 of 30 degrees when counterclockwise rotation defines positive rotation. The maximum inclination angle θ2MAX is retained toward a lower end of the flange 210BS in FIG. 7A.

Figure 8:
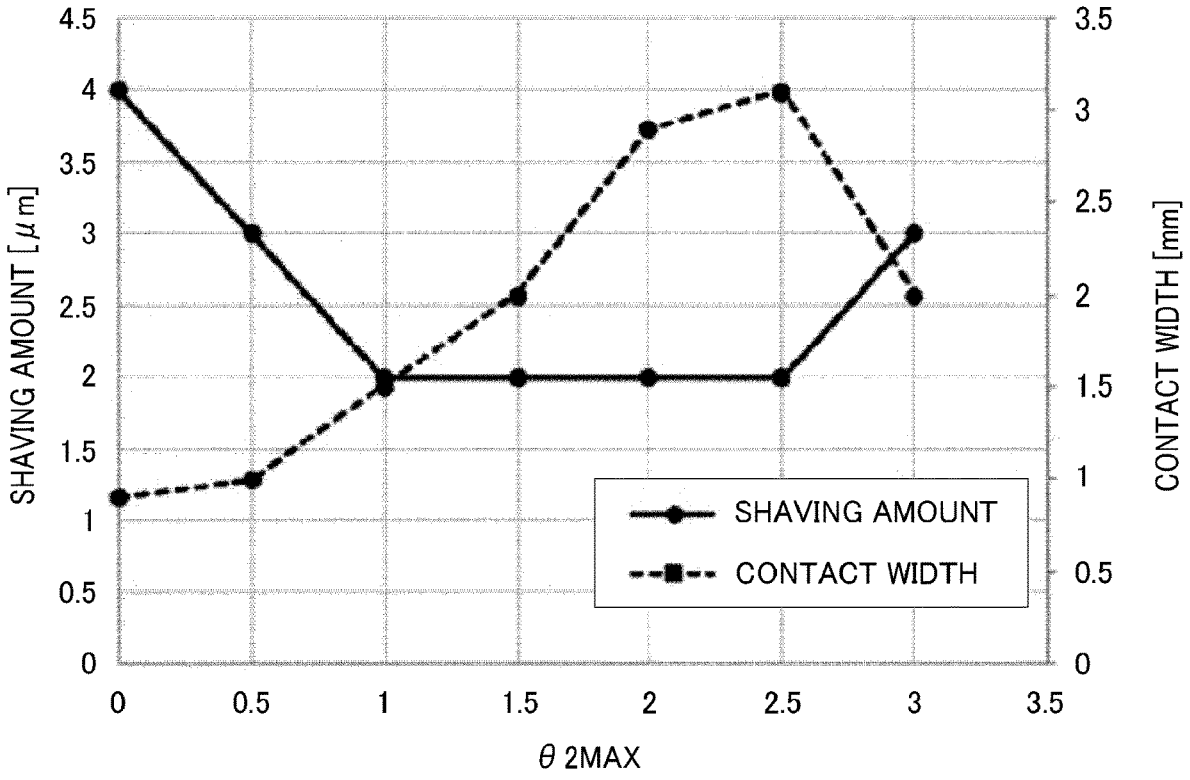
FIG. 8 is a graph illustrating a relation between a maximum inclination angle θ2MAX of the inclination angle θ2 defined by the normal line M2 of the flange depicted in FIG. 7B and an abrasion amount of the inner circumferential surface of the fixing rotator, that contacts the flange.

FIG. 8 is a graph illustrating a relation between the maximum inclination angle θ2MAX of the inclination angle θ2 defined by the normal line M2 of the flange 210BS and an abrasion amount of the inner circumferential surface of the fixing rotator 211, that contacts the flange 210BS.

In FIG. 8, supposing the product life of the fixing device 200, a vertical axis represents a shaving amount (μm) of the fixing rotator 211 after printing on 300,000 sheets of recording media and a contact width (mm) in the longitudinal direction of the fixing rotator 211 for which the fixing rotator 211 contacts the flange 210BS. A horizontal axis represents a value (e.g., an angle) of the maximum inclination angle θ2MAX.

The normal line M1 of the flange 210BS defines the maximum inclination angle θ1MAX of 2.5 degrees.

The contact width for which the fixing rotator 211 contacts the flange 210BS is measured by applying grease on a surface of the flange 210BS and observing a shape of the grease that is peeled off.

As illustrated in FIG. 8, as the maximum inclination angle θ2MAX increases, the shaving amount at the position on the inner circumferential surface of the fixing rotator 211, that is disposed opposite the vicinity of the spot A in FIG. 7C, decreases. As the maximum inclination angle θ2MAX increases, the contact width originated at the vicinity of the spot A in FIG. 7C increases.

This means that since the contact width increases as the maximum inclination angle θ2MAX increases, the maximum value of surface pressure exerted to the inner circumferential surface of the fixing rotator 211 decreases, thus reducing the abrasion amount of the fixing rotator 211.

Conversely, as the maximum inclination angle θ2MAX exceeds 2.5 degrees, the shaving amount of the inner circumferential surface of the fixing rotator 211 starts increasing. It is because contact of the fixing rotator 211 with the flange 210BS originates at the vicinity of the spot B in FIG. 7C and abrasion of the portion of the fixing rotator 211, that is disposed opposite the vicinity of the spot B, increases.

Accordingly, the maximum inclination angle θ2MAX is in a range of from 1 degree to 3 degrees preferably and 2.5 degrees more preferably.

As described above, in the fixing device 200 according to this embodiment, in the upstream side and the downstream side of the flange 210BS in the rotation direction D211 of the fixing rotator 211, each of the inclination angle θ1 defined by the normal line M1 in the second portion in the downstream side of the flange 210BS and the inclination angle θ2 defined by the normal line M2 in the second portion in the upstream side of the flange 210BS is greater than that in the first portion of the flange 210BS.

Accordingly, even if the fixing device 200 employs the fixing rotator 211 having a relatively great Young's modulus, the restrictor 210S advantageously suppresses abrasion of the fixing rotator 211 more effectively.

A description is provided of a configuration of a restrictor 210T according to a third embodiment of the present disclosure.

Figure 9A:
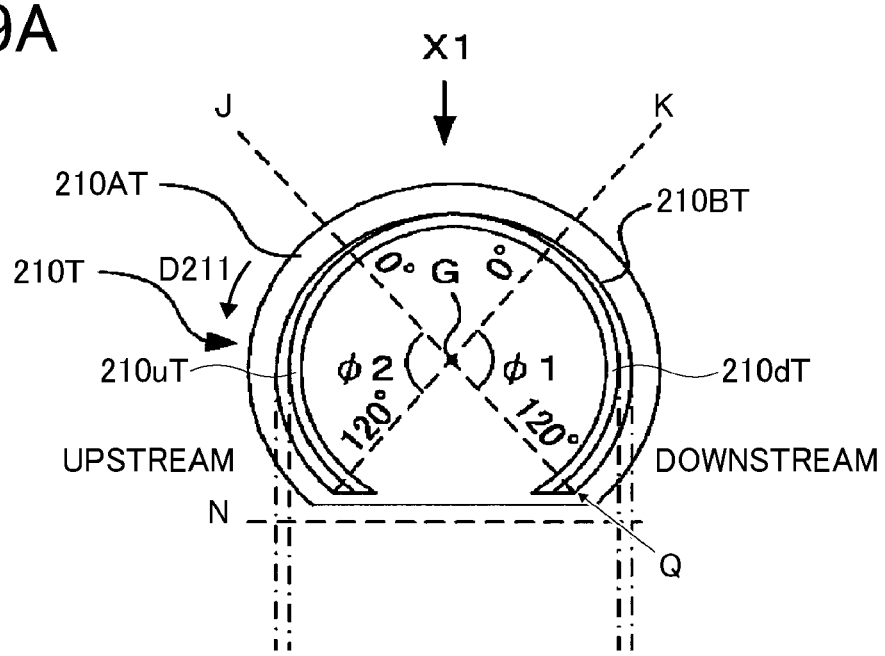
FIG. 9A is a front view of a restrictor according to a third embodiment, that is installable in the fixing device incorporated in the image forming apparatus depicted in FIG. 1.
Figure 9B:
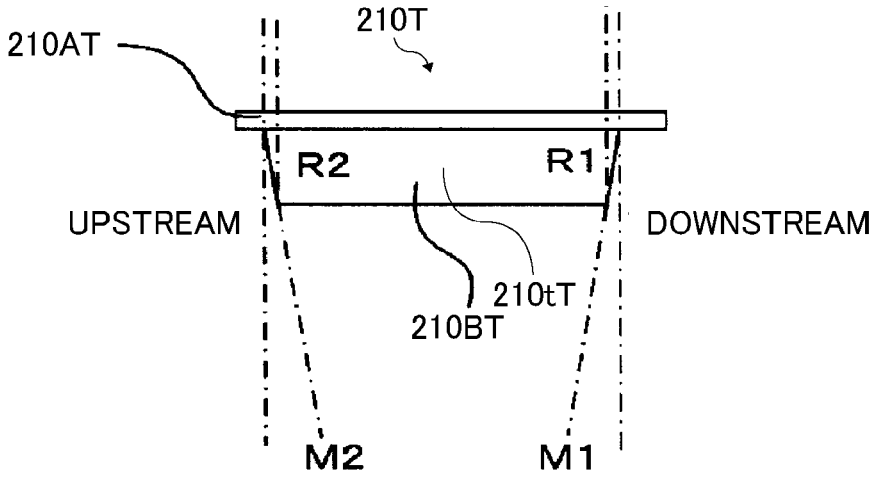
FIG. 9B is a plan view of the restrictor depicted in FIG. 9A, seen in the direction X1 in FIG. 9A.
Figure 9C:
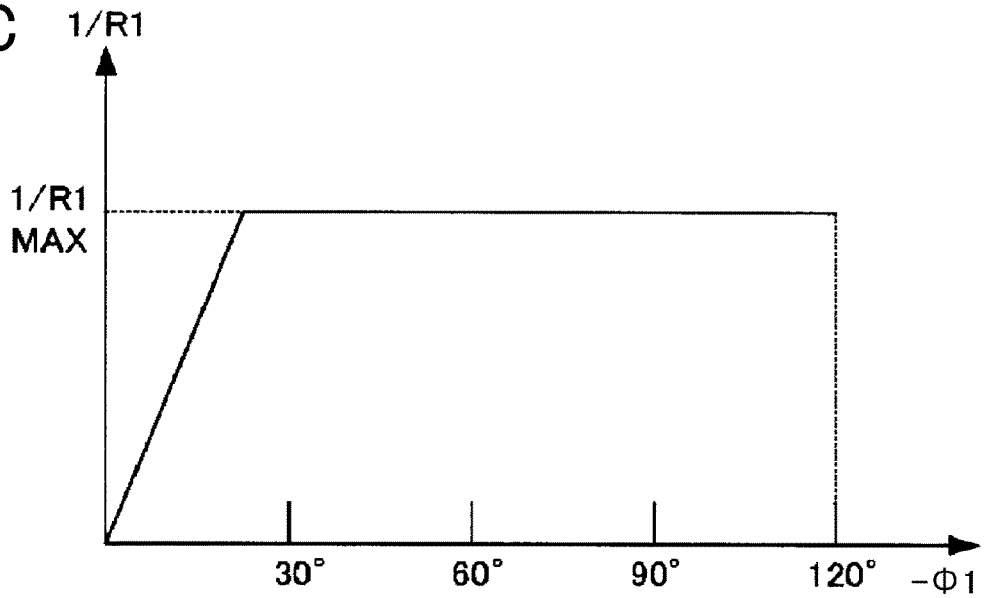
FIG. 9C is a graph illustrating a curvature 1/R1 defined by a normal line M1 of a flange of the restrictor depicted in FIG. 9B.
Figure 9D:
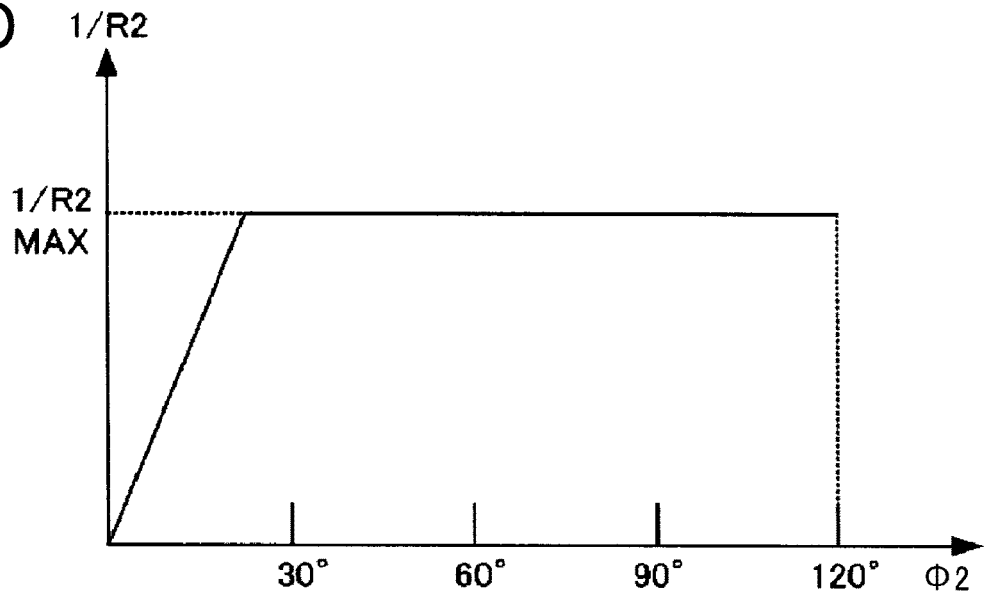
FIG. 9D is a graph illustrating a curvature 1/R2 defined by the normal line M2 of the flange of the restrictor depicted in FIG. 9B.
Figure 9E:
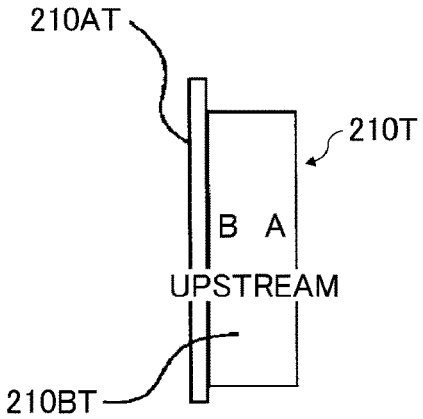
FIG. 9E is a side view of the restrictor depicted in FIG. 9A.

FIGS. 9A, 9B, 9C, 9D, and 9E are diagrams illustrating the configuration of the restrictor 210T according to the third embodiment, that is installable in the fixing device 200 depicted in FIG. 1. As illustrated in FIGS. 9A, 9B, and 9E, the restrictor 210T includes an axial direction restricting portion 210AT and a flange 210BT. FIG. 9A is a front view of the restrictor 210T. FIG. 9B is a plan view of the restrictor 210T, seen in the direction X1 in FIG. 9A. FIG. 9C is a graph illustrating a curvature 1/R1 defined by the normal line M1 of the flange 210BT, that is disposed on a downstream side of the flange 210BT in the rotation direction D211 of the fixing rotator 211. FIG. 9D is a graph illustrating a curvature 1/R2 defined by the normal line M2 of the flange 210BT, that is disposed on an upstream side of the flange 210BT in the rotation direction D211 of the fixing rotator 211. FIG. 9E is a side view of the restrictor 210T, illustrating the upstream side of the flange 210BT.

As illustrated in FIGS. 9A and 9B, the curvature 1/R1 defined by the normal line M1 and the curvature 1/R2 defined by the normal line M2 of the flange 210BT of the restrictor 210T increase from a top face 210*t*T serving as the first portion to a lower end of a downstream side face 210*d*T serving as the second portion and a lower end of an upstream side face 210*u*T serving as the second portion. For example, the downstream side face 210*d*T is disposed downstream from the fixing nip N in the rotation direction D211 of the fixing rotator 211. The upstream side face 210*u*T is disposed upstream from the fixing nip N in the rotation direction D211 of the fixing rotator 211.

More specifically, the restrictor 210T includes the flange 210BT that is inclined with a curvature that increases in a separation direction in which the flange 210BT separates from the inner circumferential surface of the fixing rotator 211 from the first portion disposed farthest from the fixing nip N to the second portion disposed in proximity to the fixing nip N.

More preferably, in the front view, the straight line J passes through the downstream lower end Q of the flange 210BT and the axis G. The straight line K is defined by the straight line J that is rotated about the axis G counterclockwise in FIG. 9A by 120 degrees. The curvature 1/R1 defined by the normal line M1 starts increasing from a position in proximity to an intersection where the straight line K intersects the flange 210BT. The intersection defines 0 degree. The curvature 1/R1 defines a maximum curvature 1/R1MAX at a position in proximity to a most downstream portion of the flange 210BT in the recording medium conveyance direction or the rotation direction D211 of the fixing rotator 211. The most downstream portion of the flange 210BT defines −100 1 of 30 degrees when counterclockwise rotation defines positive rotation. The maximum curvature 1/R1MAX is retained toward a lower end of the flange 210BT in FIG. 9A.

The curvature 1/R2 defined by the normal line M2 starts increasing from a position in proximity to an intersection where the straight line J intersects the flange 210BT. The intersection defines 0 degree. The curvature 1/R2 defines a maximum curvature 1/R2MAX at a position in proximity to a most upstream portion of the flange 210BT in the recording medium conveyance direction or the rotation direction D211 of the fixing rotator 211. The most upstream portion of the flange 210BT defines φ2 of 30 degrees when counterclockwise rotation defines positive rotation. The maximum curvature 1/R2MAX is retained toward the lower end of the flange 210BT in FIG. 9A.

Figure 10:
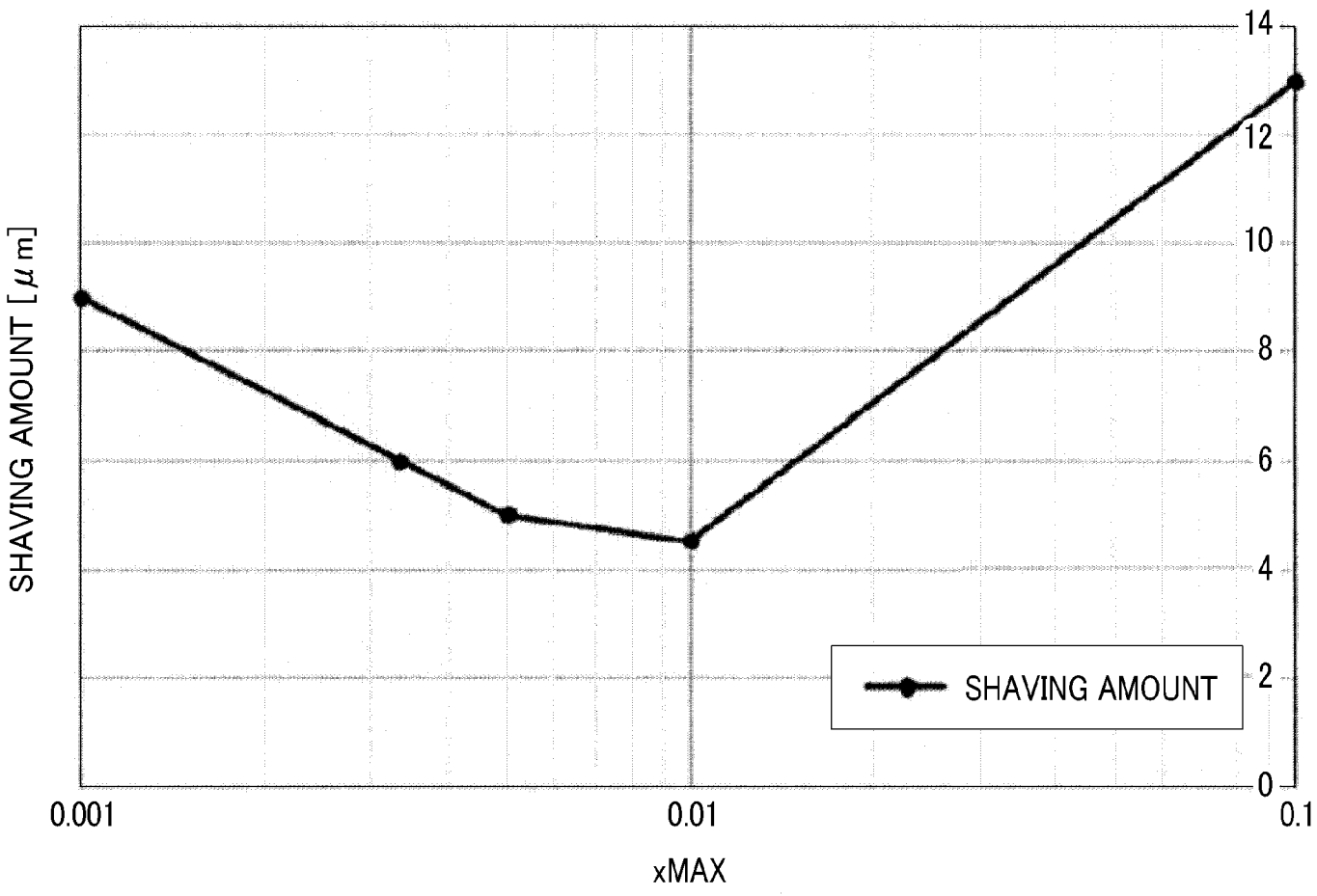
FIG. 10 is a graph illustrating a relation between a maximum curvature xMAX of a curvature x of the flange depicted in FIG. 9A and an abrasion amount of the inner circumferential surface of the fixing rotator, that contacts the flange.

FIG. 10 is a graph illustrating a relation between a maximum curvature xMAX of a curvature x (e.g., the curvature 1/R1 or 1/R2) defined by the normal line M1 or M2 of the flange 210BT and an abrasion amount of the inner circumferential surface of the fixing rotator 211, that contacts the flange 210BT.

In FIG. 10, supposing the product life of the fixing device 200, a vertical axis represents a shaving amount (μm) of the fixing rotator 211 after printing on 300,000 sheets of recording media. A horizontal axis represents a value of the maximum curvature xMAX.

As illustrated in FIG. 10, as the maximum curvature xMAX increases, the shaving amount at the position on the inner circumferential surface of the fixing rotator 211, that is disposed opposite the vicinity of the spot A in FIG. 9E, decreases.

Conversely, as the maximum curvature xMAX exceeds 0.01, the shaving amount of the inner circumferential surface of the fixing rotator 211 starts increasing. It is because a contact area with which the fixing rotator 211 contacts the flange 210BT is maximum in a vicinity of a position where x equals to 0.01. Conversely, as x increases further, the contact area with which the fixing rotator 211 contacts the flange 210BT decreases, thus accelerating abrasion of the fixing rotator 211.

Accordingly, the maximum curvature xMAX is zero in the first portion of the flange 210BT. The maximum curvature xMAX is in a range of from 0.005 to 0.02 preferably and is 0.01 more preferably in the second portion of each of the downstream side and the upstream side of the flange 210BT in the rotation direction D211 of the fixing rotator 211.

According to the third embodiment, the second portion of each of the downstream side and the upstream side of the flange 210BT in the rotation direction D211 of the fixing rotator 211 has a curvature. Alternatively, the second portion of one of the downstream side and the upstream side of the flange 210BT in the rotation direction D211 of the fixing rotator 211 may have a curvature.

As described above, in the fixing device 200 according to the third embodiment, each of the curvature 1/R1 defined by the normal line M1 in the second portion in the downstream side of the flange 210BT in the rotation direction D211 of the fixing rotator 211 and the curvature 1/R2 defined by the normal line M2 in the second portion in the upstream side of the flange 210BT in the rotation direction D211 of the fixing rotator 211 is greater than that in the first portion of the flange 210BT.

Accordingly, even if the fixing device 200 employs the fixing rotator 211 having a relatively great Young's modulus, the restrictor 210T advantageously suppresses abrasion of the fixing rotator 211 more effectively.

A method of setting the straight lines K and J according to each of the embodiments described above is not limited to conditions of each of the embodiments.

A description is provided of advantages of a fixing device (e.g., the fixing device 200).

As illustrated in FIGS. 1, 3, 5A, 7A, and 9A, the fixing device includes a fixing rotator (e.g., the fixing rotator 211), a pressure rotator (e.g., the pressure roller 203), and a restrictor (e.g., the restrictors 210, 210S, and 210T).

The fixing rotator is an endless belt that is endless and rotates in a rotation direction (e.g., the rotation direction D211). The pressure rotator contacts an outer circumferential surface of the fixing rotator to form a nip (e.g., the fixing nip N) between the fixing rotator and the pressure rotator. The restrictor includes a flange (e.g., the flanges 210B, 210BS, and 210BT) that is disposed opposite each lateral end of the fixing rotator in an axial direction thereof. The flange contacts an inner circumferential surface of the fixing rotator. The flange includes a first portion (e.g., the top faces 210*t*, 210*t*S, and 210*t*T) disposed farthest from the nip and a second portion (e.g., the downstream side faces 210*d* and 210*d*T and the upstream side faces 210*u*S and 210*u*T) disposed in proximity to the nip. The flange is inclined to define a distance from the inner circumferential surface of the fixing rotator to the flange in a separation direction in which the flange separates from the inner circumferential surface of the fixing rotator. The distance increases from the first portion to the second portion.

Accordingly, even if the fixing device employs the fixing rotator having a relatively great Young's modulus, the restrictor suppresses abrasion of the fixing rotator and resultant damaging to the fixing rotator.

According to the embodiments described above, a fixing belt (e.g., the fixing rotator 211) serves as a fixing rotator. Alternatively, a fixing film, a fixing sleeve, or the like may be used as a fixing rotator. Further, the pressure roller 203 serves as a pressure rotator. Alternatively, a pressure belt or the like may be used as a pressure rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device, comprising:

a fixing rotator that is endless, the fixing rotator configured to rotate in a rotation direction;

a pressure rotator configured to contact an outer circumferential surface of the fixing rotator to form a nip between the fixing rotator and the pressure rotator; and a flange disposed opposite a lateral end of the fixing rotator in an axial direction of the fixing rotator and configured to contact an inner circumferential surface of the fixing rotator, wherein the flange includes a first portion disposed farthest from the nip at a first rotation angle in the rotation direction; and a second portion disposed in proximity to the nip at a second rotation angle in the rotation direction, the flange is, inclined to define a distance from the inner circumferential surface of the fixing rotator to the flange in a separation direction in which the flange separates from the inner circumferential surface of the fixing rotator, the distance increasing from the first portion to the second portion, the flange has an inclination angle defined by a normal line, and the inclination angle increases from the first rotation angle to the second rotation angle.

2. The fixing device according to claim 1, wherein the inclination angle is zero in the first portion, and wherein the inclination angle has a maximum in a range of from 1 degree to 3 degrees in the second portion.

3. The fixing device according to claim 1, wherein the flange has a curvature that increases from the first rotation angle to the second rotation angle.

4. The fixing device according to claim 3, wherein the curvature is zero in the first portion.

5. The fixing device according to claim 1, wherein the fixing rotator has a Young's modulus in a range of from 70 Gpa to 300 Gpa.

6. The fixing device according to claim 1, wherein the second portion is disposed downstream from the nip in the rotation direction of the fixing rotator.

7. The fixing device according to claim 1, wherein the flange further includes another second portion that is disposed upstream from the nip in the rotation direction of the fixing rotator.

8. The fixing device according to claim 1, further comprising an axial direction restricting portion configured to contact a lateral edge of the fixing rotator in the axial direction of the fixing rotator.

9. The fixing device according to claim 1, wherein the first portion includes a top face of the flange and the second portion includes a side face of the flange.

10. An image forming apparatus, comprising:

an image bearer configured to hear an age; and a fixing device configured to fix the image on a recording medium, wherein the fixing device includes a fixing rotator that is endless, the fixing rotator configured to rotate in a rotation direction;

a pressure rotator configured to contact an outer circumferential surface of the fixing rotator to form a nip between the fixing rotator and the pressure rotator; and a flange disposed opposite a lateral end of the fixing rotator in an axial direction of the fixing rotator and configured to contact an inner circumferential surface of the fixing rotator, the flange includes a first portion disposed farthest from the nip at a first rotation angle in the rotation direction; and a second portion disposed in proximity to the nip at a second rotation angle in the rotation direction, the flange is inclined to define a distance from the inner circumferential surface of the fixing rotator to the flange in a separation direction in which the flange separates from the inner circumferential surface of the fixing rotator, the distance increasing from the first portion to the second portion, the flange has an inclination angle defined by a normal line, and the inclination angle increases from the first rotation angle to the second rotation angle.

* * * * *